US011632978B2

(12) United States Patent
Rojo-Calderon et al.

(10) Patent No.: US 11,632,978 B2
(45) Date of Patent: Apr. 25, 2023

(54) AEROSOL-GENERATING ARTICLE AND METHOD FOR MANUFACTURING SUCH AEROSOL-GENERATING ARTICLE; AEROSOL-GENERATING DEVICE AND SYSTEM

(71) Applicant: PHILIP MORRIS PRODUCTS S.A., Neuchatel (CH)

(72) Inventors: Noelia Rojo-Calderon, Neuchatel (CH); Rui Nuno Batista, Morges (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 448 days.

(21) Appl. No.: 15/769,440

(22) PCT Filed: Oct. 21, 2016

(86) PCT No.: PCT/EP2016/075315
§ 371 (c)(1),
(2) Date: Apr. 19, 2018

(87) PCT Pub. No.: WO2017/068099
PCT Pub. Date: Apr. 27, 2017

(65) Prior Publication Data

US 2018/0279681 A1 Oct. 4, 2018

(30) Foreign Application Priority Data

Oct. 22, 2015 (EP) ..... 15190942

(51) Int. Cl.
*A24B 3/14* (2006.01)
*A24F 40/465* (2020.01)
(Continued)

(52) U.S. Cl.
CPC ..... *A24B 3/14* (2013.01); *A24C 5/01* (2020.01); *A24D 1/002* (2013.01); *A24D 1/20* (2020.01);
(Continued)

(58) Field of Classification Search
CPC ..... A24F 47/008; A24F 40/20; A24F 40/465; A24F 7/00; A61M 15/06; A24B 3/14; A24C 5/01; A24D 1/002; A24D 1/20
See application file for complete search history.

(56) References Cited

U.S. PATENT DOCUMENTS 5,119,834 A 6/1992 Shannon et al.
5,388,594 A * 2/1995 Counts ..... A24F 40/485 131/194
(Continued)

FOREIGN PATENT DOCUMENTS

CN 101855059 A 10/2010
CN 102753048 A 10/2012
(Continued)

OTHER PUBLICATIONS

PCT Search Report and Written Opinion for PCT/EP2016/075315 dated Apr. 13, 2017 (18 pages).
(Continued)

*Primary Examiner* — Galen H Hauth
*Assistant Examiner* — Yana B Krinker
(74) *Attorney, Agent, or Firm* — Oblon, McClelland, Maier & Neustadt, L.L.P.

(57) ABSTRACT

An aerosol-generating article (10) has a longitudinal extension and comprises aerosol-generating substrate (20, 21) extending along the longitudinal extension and susceptor material (30, 31) extending along the longitudinal extension. The aerosol-forming substrate (20, 21) and the susceptor material (30, 31) form an extrudate having a same cross-
(Continued)

sectional shape along a length of the extrudate. Also disclosed is an aerosol-generating device, which comprises a device housing (70) comprising a support element (8) extending from a proximal end of the device housing (70). The support element (8) is adapted for receiving an aerosol-generating article (10, 12) comprising aerosol-forming substrate (20, 21) and susceptor material (30, 31). A mouthpiece (71) of the device comprises a cavity to accommodate the support element (8) including aerosol-generating article (10, 12) mounted on the support element (8). An inductor (703) may be inductively coupled to the susceptor material (30, 31) of the aerosol-generating article (10, 12) during use.

19 Claims, 3 Drawing Sheets

(51) Int. Cl.

| | |
|---|---|
| ***A24C 5/01*** | (2020.01) |
| ***A24D 1/20*** | (2020.01) |
| ***A24D 1/00*** | (2020.01) |
| ***A24F 7/00*** | (2006.01) |
| *A24F 40/20* | (2020.01) |

(52) U.S. Cl.
CPC ..... *A24F 7/00* (2013.01); *A24F 40/465* (2020.01); *A24F 40/20* (2020.01)

(56) References Cited

U.S. PATENT DOCUMENTS

| | | | | |
|---|---|---|---|---|
| 5,396,911 | A * | 3/1995 | Casey, III | A24B 15/14 131/352 |
| 2012/0042885 | A1* | 2/2012 | Stone | A24B 15/165 131/194 |
| 2013/0255702 | A1 | 10/2013 | Griffith | |
| 2014/0305454 | A1* | 10/2014 | Rinker | A24F 40/485 131/329 |
| 2015/0245669 | A1 | 9/2015 | Cadieux | |

FOREIGN PATENT DOCUMENTS

| | | | | |
|---|---|---|---|---|
| CN | 102946747 | A | 2/2013 | |
| EP | 0430559 | | 6/1991 | |
| JP | 2015-512262 | A | 4/2015 | |
| WO | WO 95/27411 | | 10/1995 | |
| WO | WO-2011076407 | A1 * | 6/2011 | H05B 3/0014 |
| WO | WO 2015/071682 | | 5/2015 | |
| WO | WO 2015/177046 | | 11/2015 | |
| WO | WO 2015/177255 | | 11/2015 | |

OTHER PUBLICATIONS

Japanese Office Action dated Nov. 26, 2020 in Japanese Patent Application No. 2018-518639 (with English translation), 7 pages.
Rejection Decision (PCT application in the National Phase) dated Aug. 25, 2021 in corresponding Chinese Patent Application No. 201680060369.9, (with English translation)(21 pages).

* cited by examiner

AEROSOL-GENERATING ARTICLE AND METHOD FOR MANUFACTURING SUCH AEROSOL-GENERATING ARTICLE; AEROSOL-GENERATING DEVICE AND SYSTEM

BACKGROUND

This application is a U.S. National Stage Application of International Application No. PCT/EP2016/075315, filed Oct. 21, 2016, which was published in English on Apr. 27, 2017, as International Publication No. WO 2017/068099 A1. International Application No. PCT/EP2016/075315 claims priority to European Application No. 15190942.1 filed Oct. 22, 2015.

TITLE

The invention relates to an aerosol-generating article and a method for manufacturing such an aerosol-generating article. The invention also relates to an aerosol-generating device and system using an aerosol-generating article.

Various aerosol-generating articles for use in electronic heating devices are known. The aerosol-generating article comprises an aerosol-forming substrate, which is heated by a heating element in the device. Typically, a heating blade is inserted into a tobacco plug for heating the plug. The heating blade has limited heating effect on peripheral portions of the plug, while central portions tend to be overheated. Thus, upon disposal of an aerosol-generating article, it may still comprise unused tobacco substrate. In addition, energy efficiency is low due to often insufficient contact between heating element and aerosol-forming substrate.

Thus there is need for an aerosol-generating article enabling reduced material waste. In addition, it would be desirable to have a method for an efficient manufacturing of aerosol-generating articles enabling improved energy efficiency of an aerosol-generating device and system the article is used with.

BRIEF SUMMARY

According to an aspect of the present invention, there is provided an aerosol-generating article having a longitudinal extension. The article comprises aerosol-generating substrate extending along the longitudinal extension and susceptor material extending along the longitudinal extension. The aerosol-forming substrate and the susceptor material form an extrudate having a same cross-sectional shape along a length of the extrudate.

The aerosol-generating substrate and the susceptor material extend substantially along the entire longitudinal extension of the aerosol-generating article. Preferably, they extend along at least 75 percent of the longitudinal extension, more preferably at least 80 percent along the longitudinal extension of the aerosol-generating article. The aerosol-generating substrate and the susceptor material may extend along the entire longitudinal extension of the aerosol-generating article. Thus, the length of the extrudate formed by the co-extruded aerosol-forming substrate and susceptor material preferably corresponds to at least 75 percent of the longitudinal extension of the aerosol-generating article, more preferably to at least 80 percent of the entire longitudinal extension of the aerosol-generating article or corresponds to the entire longitudinal extension of the aerosol-generating article.

The aerosol-generating article, or at least the portion of the article relevant for aerosol-generation—that is susceptor material covered with aerosol-forming substrate—, is manufactured through a co-extrusion process. Generally in an extrusion process, material is shaped into a continuous form, an 'extrudate', such as for example a fiber, sheet, pipe or the like, by forcing the material through a die opening of appropriate shape. Characteristic of extrudates is that a cross-sectional shape of the extrudate is fixed through the form of the die. Thus, in the present invention, an external form, for example an external diameter, and an internal form in case of a hollow extrudate, for example an internal diameter, is fixed and identical along the length of the extrudate.

Preferably, also a cross-section is the same along the length of the extrudate. However, a cross-section may also vary along the length of the extrudate depending on the arrangement of the susceptor material in the aerosol-generating article as will be described in more detail below.

Extrusion is a reliable and consistent manufacturing process enabling mass production of aerosol-forming articles. For example, a continuous aerosol-generating article may be formed through co-extrusion of aerosol-generating substrate and susceptor material. The continuous article may then be cut into individual articles of desired length. In addition, extrusion processes allow the manufacture of extrudates having a wide variety of cross-sectional shapes.

Extrusion processes allow for the manufacture of aerosol-generating articles being very uniform and having very low manufacturing tolerances. In particular, cold extrusion, which is preferably used for manufacturing the aerosol-generating article according to the invention, allows for very close tolerances, good surface finish of the extrudate and fast extrusion speeds.

The coaxial extrusion of a susceptor material and aerosol-forming substrate provides a very close and direct physical contact between the substrate and the susceptor. Thus, heat transfer from the susceptor to the substrate is optimized. The close contact may lead to a very homogeneous temperature profile across the aerosol-forming substrate. Thus, a total amount of substrate may be reduced due to an efficient use of the substrate. As a consequence, waste of material and cost may be reduced. Yet further, overheating of the aerosol-forming substrate may be prevented and thus combustion of the substrate and combustion products formed may be reduced or prevented. The amount of heating energy may be reduced, which may in particular be advantageous in view of longer operation time of a device or in view of battery capacity or battery size of an electronic heating device. Improved heat transfer and large contact areas may also lead to a faster heating-up of the aerosol-forming substrate and thus to shorter start-up times and less energy required for a device to get ready for use.

Depending on design and arrangement of the susceptor, and also on composition and amount of aerosol-forming substrate, a dosing regime may be chosen and varied according to a user's needs, for example, to achieve a specific consuming experience. The specific consuming experience may be varied by varying, for example, the arrangement of the susceptor, and additionally or alternatively by varying, for example an amount or composition of the aerosol-forming substrate. A dosing regime may, for example, be chosen to generate an equivalent of a predefined number of puffs, for example for one or more consuming experiences. Thus, consumption may be optimized and waste may be avoided or reduced.

This variability and flexibility of an inductively heatable aerosol-forming article allows broad range and exclusive customization of a consuming experience.

Since extrusion may be performed in very consistent and reproducible manner, the aerosol-generating article comprising or consisting of an extrudate of susceptor material and aerosol-forming substrate may have very homogeneous aerosol delivery profiles and, additionally or alternatively, reproducible aerosol-delivery profiles. Thus, it is possible to improve consistency in aerosol formation between puffs during a consuming experience as well as repeatability between consuming experiences. In addition, also when heating different individual portions only of the aerosol-generating article (segmented heating), that is, when heating segments only of the susceptor material, a homogenous or consistent aerosol generation may be provided.

Aerosol-generating devices for use with the aerosol-generating article according to the invention may be adapted to inductive heating. For example, the device may be provided with electronics and a load network including an inductor. Thus, such devices may be manufactured, requiring less power than conventionally heated devices, for example comprising heating blades, and may provide all advantages of contactless heating (for example, no broken heating blades, no residues on heating element, electronics separated from heating element and aerosol-forming substances, facilitated cleaning of the device). In particular, performance of a device used in combination with the aerosol-generating article according to the invention may be enhanced due to a 'fresh' heating element provided with each new aerosol-generating article. No residues may accumulate on heating elements possibly negatively influencing quality and consistency of a consuming experience.

An aerosol-generating article according to the invention may comprise a string element. The string element is arranged along the longitudinal extension of the aerosol-generating article. Preferably, the string element is arranged radially outside of the susceptor material, advantageously arranged between the susceptor material and the aerosol-forming substrate. The string element may be embedded in the aerosol-forming substrate. Preferably, a string element extends along the entire length of the extrudate.

A string element may be provided for supporting and controlling the extrusion process. A string element may minimize or avoid elongation of the extrudate during and after manufacturing of the aerosol-generating article.

Preferably, the string element is provided as continuous string material for the extrusion process. The string element is co-extruded together with the aerosol-forming substrate and the susceptor material.

Preferably, the string element has a tensile strength such that an elongation of the string element is below 1 millimeter per meter under a load of 20 Newton, preferably below 0.5 millimeter per meter.

Preferably, a string element has a tensile strength above 110 MPa, preferably above 200 MPa.

A string element may, for example, have a round or flat cross section. A round cross section may, for example, have a diameter of 0.1 mm to 1.1 mm, preferably of 0.2 mm to 0.5 mm. A flat cross-section may, for example, have a side ratio from 1:2 to 1:10, with the larger dimension preferably being 0.5 mm to 2.3 mm, preferably 0.5 mm to 1.2 mm.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

The string element may, for example, be a filament or thread.

The string element may comprise or be made of natural fibers such as for example cellulose, cotton, line or bamboo.

The string element may comprise or be made of metallic fibers such as for example stainless steel fibers.

The string element may comprise or be made of carbon fibers including graphene fibers or any combination of fiber materials mentioned above.

The fibers may have a thickness in a range from 5 μm to 250 μm, preferably from 20 μm to 80 μm. The fibers may have a fiber density in a range from 0.3 g/cm$^3$ to 9 g/cm$^3$, preferably from 0.3 g/cm$^3$ to 1 g/cm$^3$ for natural fibers. If metal is used for the string element, the string element may be made from a single wire, for example stainless steel wire. A metal string element may, for example also be a multi-wire string, for example braided or weaved in any standard pattern that may allow to enhance tensile strength while preferably keeping elongation in the above specified low range.

The aerosol-forming substrate and the susceptor material and the extrudate formed by these materials may basically have any shape that may be produced in a co-extrusion process. Preferably, shapes are chosen such as to provide large surface areas. Preferably, shapes are simple shapes providing simple die forms. Preferably, a shape of an extrudate is rotationally symmetric with respect to a longitudinal axis of the extrudate.

The aerosol-forming substrate and the susceptor material may have a hollow, preferably tubular shape, forming a hollow, preferably tubular extrudate. Hollow shapes provide large surface areas and large interfaces between susceptor material and aerosol-forming substrate. In particular, hollow shapes may provide an inside and an outside formed by aerosol-forming substrate. For example, hollow-shaped susceptor material may be covered with aerosol-forming substrate on an outside or on an inside or on both, an outside and an inside of the hollow-shaped susceptor material.

Preferably, the extrudate has a cylindrical shape.

The term 'cylindrical' is herein used to include also 'substantially cylindrical'. 'Cylindrical' is to be understood to include forms which have the shape of a cylinder of circular, oval or elliptical or substantially circular, substantially oval or substantially elliptical cross-section. While various combinations and arrangements of these different shapes of extrudates are possible, in preferred embodiments the extrudate has a shape of a cylinder having a circular cross-section. In extrudates of cylindrical shape, preferably, also the susceptor material and the aerosol-forming substrate have a cylindrical shape of circular cross-section.

The susceptor material may be a continuous or discontinuous material arranged along the length of the extrudate.

The susceptor material may be a continuous material provided with gaps in between the susceptor material. The gaps may be arranged, preferably equidistantly in the susceptor material and along the length of the extrudate. A continuous susceptor material provided with gaps may, for example, be a spiral like susceptor material arranged along the extrudate.

A discontinuous susceptor material may, for example, be in the form of individual susceptor segments. At least two susceptor segments may be arranged along the longitudinal extension of the aerosol-generating article, longitudinally distanced from each other. That it, the susceptor segments include a gap in between neighbouring susceptor segments.

Distinct susceptor segments and gaps arranged in between the susceptor material allow for a segmented heating of the aerosol-forming substrate. Segmentation allows to define a limited area to be heated, limiting an interference with surrounding elements and materials. Gaps in the susceptor material may prevent an overheating of aerosol-forming substrate in the region between two neighbouring susceptor segments. Distinct susceptor segments are electrically insulated from each other.

Sizes of gaps are preferably chosen such that the quality of a consuming experience and related aerosol deliveries is not negatively influenced, and waste of aerosol-forming substrate is minimized or avoided.

One or more susceptor segments may be heated simultaneously. The segments may be heated sequentially, for a given time and according to a desired sequence.

The susceptor material may be heated, for example, via a set of induction coils. Preferably, the set of induction coils comprises a same number of induction coils as susceptor segments are comprised in the aerosol-generating article or as aerosol-forming substrate portions shall be heated. Each induction coil is then preferably provided for heating one susceptor segment.

If segmented heating is available in an aerosol-generating device, the susceptor material, in particular individual susceptor segments of the aerosol-generating article according to the invention may be heated in a sectionalized manner. This may, for example, be done serially such as to achieve a certain consuming experience, or additionally or alternatively, to achieve consistent aerosol formation according to one, two or more puffs.

In general, a susceptor is a material that is capable of absorbing electromagnetic energy and converting it to heat. When located in an alternating electromagnetic field, typically eddy currents are induced and hysteresis losses occur in the susceptor causing heating of the susceptor. Changing electromagnetic fields generated by one or several inductors, for example, induction coils of an inductive heating device heat the susceptor. The heated susceptor then transfers the heat to the surrounding aerosol-forming substrate, mainly by conduction of heat such that an aerosol is formed. Such a transfer of heat is best, if the susceptor is in close thermal contact, preferably in direct physical contact, with for example tobacco material and aerosol former of the aerosol-forming substrate. Due to the extrusion process, a close interface between susceptor and aerosol-forming substrate is formed.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, a ferromagnetic alloy, such as a ferromagnetic steel or stainless steel, ferromagnetic particles, and ferrite. A suitable susceptor may be, or comprise, aluminium. Preferred susceptors may be heated to a temperature in excess of 250 degrees Celsius.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

The susceptor may also be a multi-material susceptor and may comprise a first susceptor material and a second susceptor material. The first susceptor material may be disposed in intimate physical contact with the second susceptor material. The second susceptor material preferably has a Curie temperature that is below the ignition point of the aerosol-forming substrate. The first susceptor material is preferably used primarily to heat the susceptor when the susceptor is placed in a fluctuating electromagnetic field.

Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Suitable materials for the second susceptor material may include nickel and certain nickel alloys.

By providing a susceptor having at least a first and a second susceptor material, the heating of the aerosol-forming substrate and the temperature control of the heating may be separated. Preferably the second susceptor material is a magnetic material having a second Curie temperature that is substantially the same as a desired maximum heating temperature. That is, it is preferable that the second Curie temperature is approximately the same as the temperature that the susceptor should be heated to in order to generate an aerosol from the aerosol-forming substrate.

A longitudinal extension or length of a susceptor in the aerosol-generating article may, for example be between 4 mm and 20 mm, preferably between 4 mm and 14 mm. A lateral extension of a susceptor material or a diameter, for example, may be between 4 mm and 9 mm, preferably between 4 mm and 7 mm.

If the susceptor material is comprised of two or more segments for segmented heating of the aerosol-generating article, a length of the segments may be in a range between 0.7 mm and 10 mm. A gap in between neighbouring susceptor segments may be up to three times the length of a segment.

A susceptor material may be a sheet-like material, such as for example a foil, mesh or web. A foil may, for example, be solid metallic foil. A mesh or web may, for example, be a material made of woven, nonwoven or braided fibers, for example ferromagnetic fibers.

Nonwoven sheet material may, for example, be made of medical grade stainless steel fibers (for example grades 316 and 430). Advantageously, a fiber diameter for nonwoven materials is between 20 μm and 0.7 mm. A nonwoven sheet material preferably has a weight of between 30 $g/m^2$ and 220 $g/m^2$, preferably between 50 $g/m^2$ and 100 $g/m^2$, and advantageously a thickness of 0.06 mm to 1.1 mm, preferably of 0.06 mm to 0.5 mm, more preferably of 0.075 mm to 0.25 mm.

When using braided wires, for example stainless steel wires, for braiding a sheet material, basically any braiding pattern can be applied in order to obtain similar density as described for nonwoven sheet materials. For braided sheet material, preferably, fibers are used having a diameter from 20 μm to 0.75 mm, more preferably from 80 μm to 0.3 mm.

Woven, nonwoven or braided fibers, meshes and webs as susceptor material used in the aerosol-generating article according to the invention and during extrusion of the article, enables the aerosol-forming substrate to penetrate into interstices, in particular to surround fibers of the susceptor material during and after extrusion. Thus, the susceptor material will be embedded in the aerosol-forming substrate, providing a large and strong interface and good heat contact.

Porous susceptor materials in general, such as a mesh or web, having small or large interstices, facilitate an embedding of the susceptor material in the aerosol-forming substrate.

An 'aerosol-forming substrate' is a substrate capable of releasing volatile compounds that can form an aerosol. Volatile compounds may be released by heating or combusting the aerosol-forming substrate. As an alternative to heating or combustion, in some cases volatile compounds may be released by a chemical reaction or by a mechanical stimulus, such as ultrasound. An aerosol-forming substrate may be solid. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, aerosol-forming substrate is a tobacco containing aerosol-forming substrate. The aerosol-forming substrate may be provided in the form of a slurry.

The tobacco containing slurry and the aerosol-forming substrate made from the tobacco containing slurry comprises tobacco particles, fiber particles, aerosol former, binder and for example also flavours. Preferably, a substrate is a form of reconstituted tobacco that is formed from the tobacco containing slurry.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired coating thickness.

Fiber particles may include tobacco stem materials, stalks or other tobacco plant material, and other cellulose-based fibers such as wood fibers having a low lignin content. Fiber particles may be selected based on the desire to produce a sufficient tensile strength for the extruded substrate versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry for forming the aerosol-forming substrate may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

Preferably, a humectant content in a tobacco containing aerosol-forming substrate is in a range between 15 percent and 35 percent.

One or more aerosol former may be combined to take advantage of one or more properties of the combined aerosol formers. For example, triacetin may be combined with glycerin and water to take advantage of the triacetin's ability to convey active components and the humectant properties of the glycerin.

The aerosol-generating substrate may have an aerosol former content of between 5 percent and 30 percent on a dry weight basis. In a preferred embodiment, the aerosol-generating substrate has an aerosol former content of approximately 20 percent on a dry weight basis.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce a slurry for a tobacco containing aerosol-forming substrate includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to a substrate, the amount of fibers may be reduced or fibers may even be omitted due to the aerosol-forming substrate being stabilized by the susceptor.

If present, the fiber solution and the prepared tobacco are then mixed. The slurry is then transferred to an extrusion device. After extrusion though a respective die of the extrusion device, the extrudate is then dried, preferably by heat and cooled after drying.

Preferably, the tobacco containing slurry comprises homogenized tobacco material and comprises glycerin as aerosol former. Preferably, the coating of aerosol-forming substrate is made of a tobacco containing slurry as described above.

Preferably, the aerosol-forming substrate comprises tobacco material and an aerosol-former.

Advantageously, aerosol-forming substrate is porous to allow volatilized substances to leave the substrate. Due to large contact areas between susceptor and aerosol-forming substrate, the substrate may have low thickness such that only a small amount of substrate must be heated by the susceptor compared to aerosol-forming substrates heated by, for example, a heating blade. Thus, also substrates having no or only little porosity may be used. A substrate having small thickness may, for example, be chosen to have less porosity than a substrate having large thickness.

A thickness of an aerosol-forming substrate may be between 0.1 mm and 4 mm, preferably between 0.2 mm and 2 mm.

Aerosol-forming substrate may be varied, for example in composition, density, porosity or thickness. By varying the aerosol-forming substrate, aerosolization may be varied and controlled for a given inductive heating device. Also the delivery of different substances, such as, for example, nicotine or flavours may be varied and controlled for a given inductive heating device. In particular, an aerosol-generating system with customized performance may be provided.

The aerosol-forming substrate may further comprise at least one protection layer. A protection layer may, for example, assure or enhance a shelf life of the aerosol-generating article. Additionally or alternatively a protection layer may optimize use and vaporization behaviour of the aerosol-generating article.

A protection layer may be an outer protection layer protecting the aerosol-forming substrate against environmental influences. Preferably, an outer protection layer is a moisture protection layer.

A protection layer may also be used for marking purposes, for example, by adding a colour to an outer protection layer.

In the aerosol-generating article according to the invention, a wall thickness of the extrudate may be between 1 millimeter and 7 millimeter, preferably between 2 millimeter and 4 millimeter. The wall of the extrudate may include flat susceptor material having aerosol-forming substrate provided on both sides of the flat susceptor material. Thus, a thickness of an aerosol-forming substrate layer may be as small as, for example, 0.5 millimeter to 2 millimeter. Such thin substrate layers may be heated in a very efficient and homogeneous manner without leaving unused substrate material.

A length of an extrudate may be between 4 millimeter and 20 millimeter, preferably between 4 millimeter and 14 millimeter. An outer diameter of the extrudate may for example be between 5 millimeter and 10 millimeter, preferably between 5 millimeter and 7 millimeter. The extrudate may be a cylindrical extrudate with an outer diameter in the given range. An outer diameter may also correspond to a largest lateral or radial dimension of a non-cylindrical extrudate, which lateral or radial dimension is perpendicular to the longitudinal extension or length of the extrudate.

The extrudate may comprise a flat or a structured wall.

A flat wall represents the minimal wall area of a respective shape of extrudate. With a structured wall the total surface area of the wall may be increased. By this, a surface area for aerosol formation and evaporation may be increased. Also a total contact area between a susceptor material and the aerosol-generating substrate may be increased. An increase of contact area through such a structure may, for example, be achieved without changing a height of extrudate or of the aerosol-generating article, respectively.

With a structured wall also an amount of aerosol-forming substance per article may be enhanced, also without enhancing a thickness of the substrate. This enables an extension of a consuming experience or, additionally or alternatively, an increase of an aerosol delivery during consumption.

Preferably, a structure of a wall is a regular structure. Preferably, a structure is adapted to the size of the extrudate. The structure may overlie a wall arrangement of the extrudate.

A structured wall may, for example, be a wavy wall instead of a circular wall of a tubular shaped extrudate. A circumference of the shape of the extrudate then describes a wavy line.

An aerosol-generating article according to the invention may comprise a cover material. The cover material at least partly covers the aerosol-generating article. Preferably, the cover material at least partly envelopes an outside of the aerosol-generating article or of the extrudate of the aerosol-generating article, respectively. Advantageously, a cover material covers an entire outside of an extrudate. A cover material may cover only the outside of the extrudate. A cover material may also cover or partly cover an inside of an extrudate.

The cover material may serve as an interface between aerosol-generating article and device parts or a user, or between the aerosol-forming substrate of the aerosol-generating article and device parts or a user.

By this, device parts may be kept clean, also after consecutive usage of a device. Removal of the used aerosol-generating article may also be facilitated, avoiding or limiting sticking of a used article to residues on device parts. In addition, direct contact of an extrudate with the fingers of a user when handling the aerosol-generating article may be avoided.

A cover material may enhance a mechanical strength of the aerosol-forming article.

The cover material may basically be any kind of material suitable for use in an electronic heating device. Preferably, the cover material is a material that does not dissolve or change its main physical characteristics during a heating process in use of a device and does not dissolve in water or liquids.

Preferably, the cover material is a thin sheet-like material.

Preferably, the cover material is porous. The porosity is selected such as to enable free release of the aerosol evaporating from the heated aerosol-forming substrate.

A cover material may be a closely applied material layer or may be a more loosely applied wrapping.

For example, a cover material may be in the form of a porous material layer, for example covering the outside of the extrudate, preferably covering an aerosol-forming substrate arranged on an exterior side of the extrudate. The porous material layer may be applied to the extrudate, for example, before the aerosol-forming substrate has dried after extrusion.

A cover material may, for example, be in the form of an envelope, enveloping the outside of the extrudate. An envelope may extend into an interior of a hollow extrudate, for example may be folded at opposite ends of the aerosol-generating article into the interior of a hollow extrudate. A folding of any kind of a cover material may fix the cover material to the extrudate such that no further fixing means, such as for example an adhesive or mechanical attaching means are required.

A cover material in the form of an envelope may also be configured as shape-giving element. For example, the cover material may have the form of a cylinder enveloping an extrudate of different shape, for example of star-like or triangular shape. Thus, the cover material gives the aerosol-generating article a cylindrical shape.

The cover material may, for example, be a cellulose based material, including paper materials that comply with regulations of food and beverage industry and for example of the FDA. The cover material may be a cigarette paper, a "tea-bag" paper or a medical grade or food and beverage approved porous sheet material, for example, such paper or plastics sheet material. Suitable tea bag paper used as cover material in aerosol-generating articles according to the invention may have densities in a range of between 15 $g/m^2$ and 25 $g/m^2$, preferably between 18 $g/m^2$ and 22 $g/m^2$ (for example commercially available type IMA 21, 23, 24 and 27, non-heat sealable tea bag paper).

A thickness of the cover material may, for example, be in a range between 10 micrometer and 50 micrometer, preferably between 10 micrometer and 30 micrometer.

A length of an aerosol-generating article may be identical to the length of the extrudate. A length of the aerosol-generating article may also be slighly larger, in particular if the article is provide with a cover material in the form of an envelope. The length of the aerosol-generating article may be between 5 millimeter and 25 millimeter, preferably between 5 millimeter and 17 millimeter.

According to another aspect of the invention, there is provided an aerosol-generating device. The aerosol-generating device comprises a device housing comprising a support element extending from a proximal end of the device housing. The support element is adapted for receiving an aerosol-generating article, preferably a hollow aerosol-generating article, the article comprising aerosol-forming substrate and a susceptor material, preferably an extrudate of aerosol-forming substrate and susceptor material as described herein. The aerosol-generating article may be mounted onto the support element.

Preferably, an aerosol-generating article according to the invention and as described herein is mounted to the support element of the device. However, also different aerosol-generating articles suitable for being mounted to the support element may be used in combination with the device according to the invention. For example, (hollow tubular-shaped) inductively heatable aerosol-generating articles may be used, wherein aerosol-forming substrate and susceptor material are combined in a different way, for example by coating the susceptor material with aerosol-forming substrate or by folding susceptor material and substrate with each other.

The support element may be a centering element for supporting a positioning and self-centering of the aerosol-generating article in the aerosol-generating device. The support element may also support an adjustment of the shape of the aerosol-generating article in case of a deformed article due to inapt storing or handling of the article.

A support element may also support an assembly of the device, for example an aligning of a mouthpiece with a device housing.

Preferably, a size of the support element is adapted to the form and size of an aerosol-generating article that is to be mounted to the support element. For example, a lateral dimension of the support element may be chosen such as to leave a clearance between outer diameter of support element and aerosol-generating article. Such clearance may, for example be in a range between 0.4 mm and 0.7 mm. Clearances in this size range allow for a proper fitting of the aerosol-generating substrate assuring functionality of the article and the device.

Preferably, the support element has a same or a slightly greater length than the aerosol-generating article. For example, a length of a support element may be several millimeter longer than the length of an aerosol-generating article. For example, the length of the support element may be 1 mm to 3 mm greater than the length of the aerosol-generating article, with a total length of the article in the above indicated length range.

The support element extends over a proximal end of the device housing. This favours an unhindered access to the support element and supports a mounting of an aerosol-forming article to the support element. The support element may partially or entirely extend over the proximal end of the device housing. Preferably, the support element extends entirely over the proximal end of the device housing.

A longitudinal axis of the support element is preferably aligned with a longitudinal axis of the device housing, preferably, such that a longitudinal axis of the aerosol-generating article is aligned with the longitudinal axis of the device housing when mounted to the support element.

Preferably, the support element has a rotationally symmetric shape with respect to a longitudinal axis of the support element.

Preferably, the support element is a pin-shaped element.

Preferably, the aerosol-generating article mounted to the pin-shaped element is a hollow tubular-shaped aerosol-generating article. A hollow, tubular-shaped aerosol-generating article may comprise co-extruded aerosol-forming substrate and susceptor material as described herein. However, a hollow, tubular-shaped aerosol-generating article may also comprise a tubular-shaped susceptor material coated with aerosol-forming substrate.

Preferably, a shape of the support element allows an airflow to pass longitudinally from an upstream end to a downstream end of the aerosol-forming article, in between support element and aerosol-generating article mounted on the support element.

The terms 'upstream' and 'downstream' when used to describe the relative positions of elements, or portions of elements, of the aerosol-generating article or aerosol-generating device are used in relation to the direction in which a user draws on the aerosol-generating article during use of the device. Accordingly, a user draws on the downstream end of the aerosol-generating article so that air enters the upstream end of the aerosol-generating article and moves downstream to the downstream end.

The device further comprises a mouthpiece comprising a cavity having an internal surface shaped to accommodate the support element with aerosol-generating article mounted on the support element at least partially within the cavity.

Preferably, a length of the cavity of the mouthpiece is equal or longer than the length of the aerosol-generating article so that when the aerosol-generating article is received in the cavity of the mouthpiece, the aerosol-generating article is entirely accommodated in the cavity of the mouthpiece.

Thus, an aerosol-generating article mounted on the support element is preferably entirely covered by the mouthpiece of the device.

Preferably, the cavity of the mouthpiece is substantially cylindrical. Preferably, the cavity of the mouthpiece has a diameter substantially equal to or slightly greater than the diameter of the aerosol-generating article.

The internal surface of the cavity of the mouthpiece and the support element are, in an assembled state of the device, arranged at a predefined distance and next to each other.

The predefined distance is selected to allow an aerosol-generating article to be arranged on the support element in the cavity. Preferably, the predefined distance is selected to leave a predefined air-path between an outside of the aerosol-generating article and the internal surface of the cavity of the mouthpiece.

The aerosol-forming device further comprises an inductor of a load network, which inductor is inductively coupled to the susceptor material of the aerosol-generating article during use. The inductor may be in the form of one or several coils. An induction coil may, for example be arranged around a cavity the aerosol-generating article is accommodated in. Preferably, a coil is embedded in a wall portion of the mouthpiece surrounding the cavity.

An induction coil may also be arranged at a proximal end of the device housing, for example embedded in a device housing wall, for example, if the support element is arranged in a recess of the housing. The recess then provides enough space for an aerosol-generating article to be accommodated in the recess.

The mouthpiece is the most downstream element of the aerosol-generating device. A user contacts the mouthpiece in order to pass an aerosol generated by the aerosol-generating article through the mouthpiece to the user. A mouthpiece may comprise a filter segment. A filter segment may have low particulate filtration efficiency or very low particulate filtration efficiency. A filter segment may be a cellulose acetate filter plug made of cellulose acetate tow.

The mouthpiece may comprise a mixing chamber for homogenizing an airflow through the mouthpiece before the airflow leaves the mouthpiece. The mixing chamber is arranged downstream of the cavity. An airflow passing the aerosol-generating article may pick up evaporated aerosol and passes the mixing chamber preferably in a turbulent flow. Thus, the chamber has a blending effect, homogenizing an aerosol flow before the aerosol flow leaves the mouthpiece.

The mouthpiece may comprise an airflow alteration element arranged in an air-path within the mouthpiece. The airflow alteration element is arranged downstream of the cavity and upstream of or in a mixing chamber. The airflow alteration element may comprise one or several internal paths for an airflow to pass through. An airflow passing aerosol-generating article, for example on an outside and in case of a hollow shaped aerosol-generating article, also through an interior of the article, preferably passes through the one or several internal paths of the airflow alteration element.

An airflow passing through internal paths of the airflow alteration element and through external paths may be combined in the mixing chamber.

An airflow alteration element may additionally be a positioning element for aligning the support element and the mouthpiece.

According to yet another aspect of the invention there is provided a method for manufacturing an aerosol-generating article. The method comprises the step coaxially extruding aerosol-forming substrate and susceptor material through a die opening of an extrusion device, thereby forming an extrudate having a fixed cross-sectional shape. The extrudate comprises the aerosol-forming substrate and the susceptor material.

The aerosol-forming substrate is provided in an extrudable consistency, for example as aerosol-forming slurry.

The method according to the invention may further comprise the step of coaxially extruding a continuous string material together with the aerosol-forming substrate and the susceptor material. The string material, for example, a filament or thread, is preferably arranged between the aerosol-forming substrate and the susceptor material and provided for controlling the extrusion process of the aerosol-forming substrate and the susceptor material. Preferably, the string material has a minimum tensile strength in order to avoid or minimize a longitudinal extension of the extrudate during extrusion or after extrusion.

In a further method step of covering the extrudate at least partially with a cover material, preferably a porous cover material, the extrudate may be provided with a protection against mechanical and environmental influences, as well as with a mechanical stabilization. Preferably, the aerosol-generating article is provided with a cover material after extrusion.

A cover material may be provided either to an inside or an outside or to an inside and an outside of the aerosol-generating article after performing the step of extruding the aerosol-forming substrate and susceptor material. Depending on an embodiment of the aerosol-generating article, a cover material may be provided to a continuous extrudate before cutting said extrudate into individual extrudates of desired length. A cover material may be provided before or after a drying step of the extruded aerosol-forming substrate.

A cover material may be applied to the extrudate by wrapping the extrudate and enveloping the extrudate in the cover material.

Further aspects and advantages of the method according to the invention have been described relating to the aerosol-generating article according to the invention and will therefore not be repeated.

According to another aspect of the invention, there is provided an aerosol-generating system. The system comprises an aerosol-generating device according to the invention and as described herein. The system also comprises an aerosol-generating article comprising aerosol-forming substrate and susceptor material, which aerosol-generating article is mounted to a support element of the aerosol-generating device. Preferably, the aerosol-generating article used in the system according to the invention is or comprises an extrudate of susceptor material and aerosol-forming substrate. The system further comprises a power source connected to a load network. The load network comprises an inductor for being inductively coupled to the susceptor material of the aerosol-generating article.

Aspects and advantages of the system according to the invention have been described relating to the aerosol-generating article according to the invention and the aerosol-generating device according to the invention and will not be repeated.

BRIEF DESCRIPTION OF THE DRAWINGS

The invention is further described with regard to embodiments, which are illustrated by means of the following drawings, wherein.

BRIEF DESCRIPTION OF THE DRAWINGS

Figure 1:
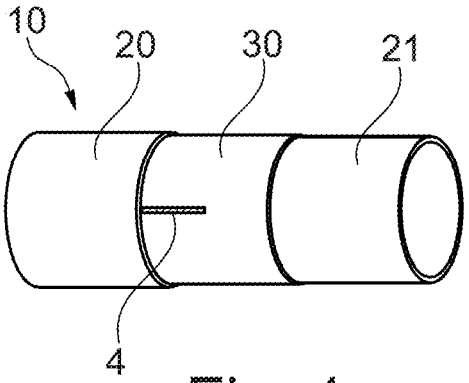
FIG. 1 shows a first embodiment of a tubular aerosol-generating article with susceptor foil.
Figure 2:
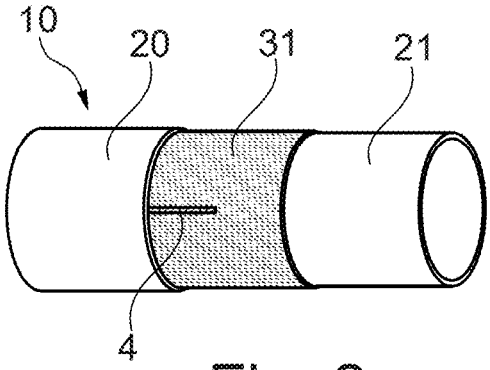
FIG. 2 shows a second embodiment of a tubular aerosol-generating article with porous susceptor sheet.

In FIG. 1 and FIG. 2 aerosol-generating articles 10 in the shape of hollow tubes are shown. The articles 10 consist of an extrudate comprising a susceptor material 30,31 in between aerosol-forming substrate 20,21. For better illustration, the inner components of the article 10 are shown by way of a stepwise cut-away of outer components. In the real article, all such cutaway components extend along the entire length of the article 10.

In FIG. 1 the susceptor material 30 is a susceptor foil, for example a metallic foil. The foil forms a physical barrier between the inner 21 and the outer 20 aerosol-forming substrate during and after extrusion.

In FIG. 2 the susceptor material 31 is a susceptor mesh or grid, for example made of non-woven metallic fibers such as stainless steel fibers. The mesh allows that aerosol-forming substrate may surround the fibers during and after extrusion of the article.

A string element 4 in the form of a thread is arranged between the outer aerosol-forming substrate 20 and the susceptor material 30,31. The string element 4 extends in longitudinal direction in a straight line along the extrudate. The string element 4 has a minimum tensile strength to limit elongation of the article 10 during the extrusion process. A minimum tensile strength may, for example be 110 MPa.

Preferably both aerosol-forming substrate 20,21 are tobacco containing substrates. They may be identical such that one tobacco slurry only may be prepared for the manufacture of the articles 10.

Figure 3:
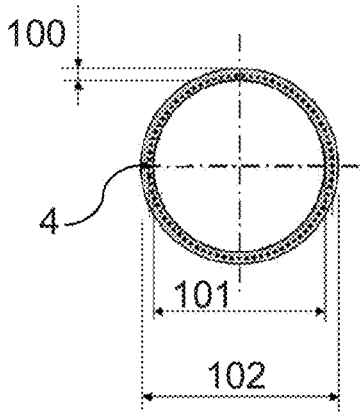
FIG. 3 is a cross section of the article of FIG. 1 or FIG. 2.

In FIG. 3 a cross section through the article 10 of FIG. 1 and FIG. 2 is shown. An inner diameter 101 of the hollow tube is in a range between 4 mm and 7 mm. An outer diameter 102 of the hollow tube is in a range between 5 mm and 7 mm. Accordingly, a wall thickness 100 of the tube is in a range between 1 mm and 3 mm. Inner and outer aerosol-forming substrate 21,20 may have a same thickness and the susceptor 30,31 may be arranged in the middle of the wall when seen in radial direction.

Figure 4:
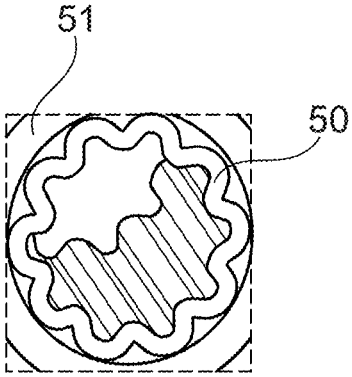
FIG. 4 shows an extrusion die form for manufacturing a structured tubular extrudate.

FIG. 4 shows an extrusion die for extruding aerosol-generating articles having a structured wall. The die comprises an outer circular tube 51 coaxially arranged with an inner tube 50 having an undulating wall structure. In this embodiment, the otherwise flat round walls of a tubular shaped extrusion die form a regular circumferentially running wave. The circumference of the shape of a hollow tube manufactured by such an extrusion die describes a wavy line.

A side wall of a tubular shaped aerosol-generating article, may be flat as, for example shown in FIG. 1 and FIG. 2, or may be structured. Preferably, the form of the susceptor material is adapted to the corresponding structure of the side wall.

Preferably, a structure is adapted to the size of the tube.

Figure 5:
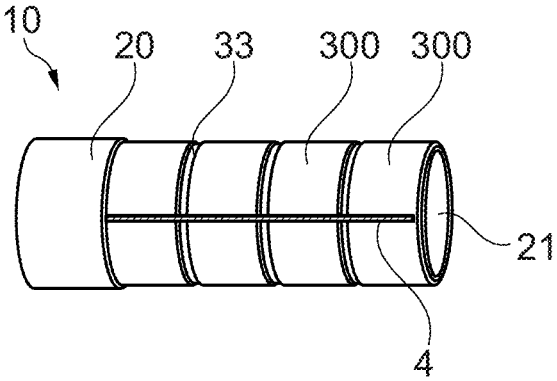
FIG. 5 shows a first embodiment of an aerosol-generating article for segmented heating.
Figure 6:
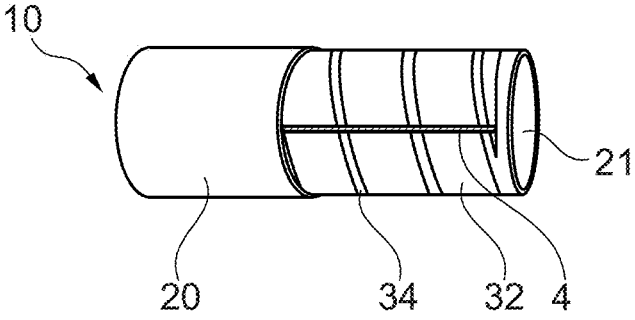
FIG. 6 shows a second embodiment of an aerosol-generating article for segmented heating.

In FIG. 5 and FIG. 6 tubular aerosol-generating articles 10 are shown that are adapted for a segmented heating, for example for being sequentially heated.

In FIG. 5 the susceptor material is provided in the form of several tubular-shaped susceptor segments 300. The individual segments 300 are equidistantly arranged along the length of the article and are separated by gaps 33. Each segment 300 may be heated separately for a given time according to a desired sequence. The gap 33 provides that heat is not dispersed into the surrounding area but is limited to the portion of the article next to and corresponding to the heated susceptor segment 300. The gap 33 may also prevent that an area between segments is overheated, which might negatively influence the quality of a consuming experience and related aerosol delivery. At the same time waste may be minimized by heating a portion only required for a desired aerosol formation. In the embodiment of FIG. 5, the string element 4 may support the equidistant positioning of the distinct susceptor segments 300 upon extrusion of the article 10.

In FIG. 6 the susceptor material has the form of a helix arranged along the article 10. The susceptor material is a susceptor band 32 that may during the extrusion process continuously be unwound from a bobbin and positioned helicoidally along the extrusion axis (corresponding to the longitudinal axis of the extruded article). The continuous gap 34 formed in between the wound susceptor band 32 provides a certain thermal separation between the individual windings of the band 32. While still a certain heat transfer is possible along the band, this embodiment simplified the extrusion process and reduces costs of the product.

In this embodiment, the string element 4 may additionally support a regular positioning of the susceptor band 32.

Figure 7:
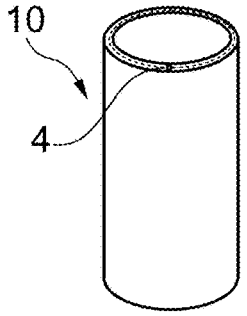
FIG. 7,8,9 show three embodiments of aerosol-generating articles: plain (FIG. 7), with cover layer (FIG. 8) and with envelope (FIG. 9)

In FIG. 7 an aerosol-generating article 10 being a hollow tube and consisting of an extrudate of a coextruded susceptor material and aerosol-forming substrate is shown. The length of the article 10, in this case corresponding to the length of the extrudate, preferably lies in a range between 4 mm and 14 mm.

Figure 8:
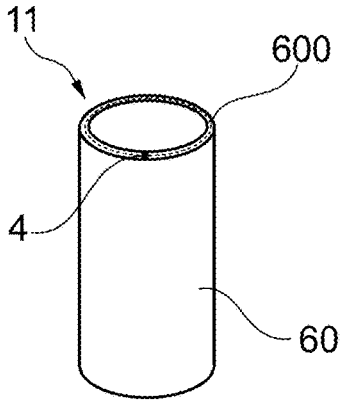

In FIG. 8 the aerosol-generating article of FIG. 7 is provided with a cover layer 60. The cover layer 60 covers the outside of the article 11 or the extrudate, respectively. Depending on an application process of the cover layer, the cover layer 60 may cover or not cover end sides 600 of the hollow tube. Preferably, the cover layer is a thin porous material, for example a "tea bag" paper. Preferably, the cover layer 60 is tightly arranged around the outside of the extrudate. The cover layer 60 may be applied while an aerosol-forming substrate has not yet dried after an extrusion process.

Figure 9:
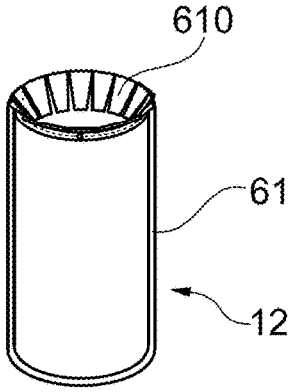

In FIG. 9 the aerosol-generating article of FIG. 7 is provided with an envelope 61. The envelope 61 is a loose wrapping and covers the outside of the article or the extrudate, respectively. The envelope is a sheet of porous material that is folded into the inner space of the tube on each end of the tube. By this, the envelope 61 automatically covers the end sides 600 of the hollow tube. The sheet material for the envelope is provided with incisions such that each end portion of the tube is provided with a plurality of inwardly directing flaps 610. Preferably, an envelope 61 is loosely arranged around the extrudate and is attached to the extrudate through the folding of the envelope 61.

A loose envelope 61 may be marked, for example for branding, without using ink, for example by embossing the envelope material.

The length of the article 12 including the envelope preferably lies in a range between 5 mm and 17 mm.

Preferably, the envelope 61 is a thin porous material, for example a "tea bag" paper.

Aerosol-generating articles manufactured through extrusion do not necessarily have to be of hollow tubular shape.

Figure 10:
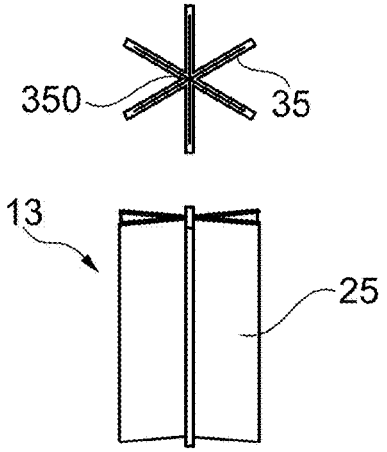
FIG. 10 shows a star-shaped aerosol-generating article (plain)
Figure 11:
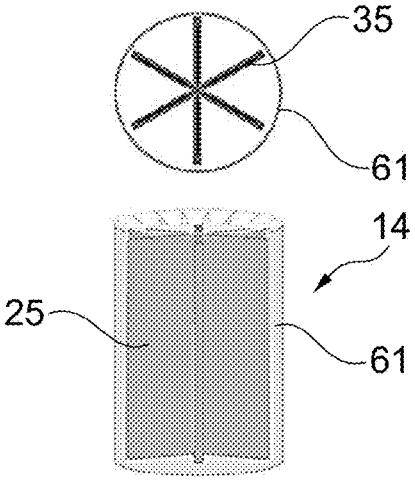
FIG. 11 shows the article of FIG. 10 with envelope.

FIG. 10 and FIG. 11 show examples of aerosol-generating articles 13, 14 manufactured through extrusion and having a star-shaped cross section. Three susceptor material strips form a star-shaped susceptor 35 with a center 350 and six susceptor flaps extending radially from the center. The susceptor strips are covered on both sides with aerosol-forming substrate 25.

In FIG. 11 the star-shaped aerosol-forming article 13 of FIG. 10 is provided with an envelope 61 as described above and with reference to FIG. 9. The envelope 61 gives the article 14 a cylindrical tubular shape.

Figure 12:
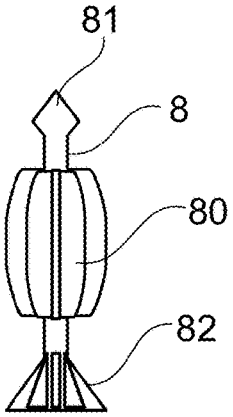
FIG. 12-14 show a support element and tubular aerosol-generating article in separate (FIG. 12 and FIG. 13) and assembled position (FIG. 14)

FIG. 12 shows a support element 8 for holding and centering a hollow tubular-shaped aerosol-forming article.

Figure 13:
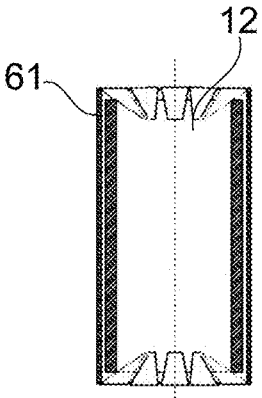

In this example, the aerosol-forming article as shown in FIG. 13 in a cross-sectional view is provided with an envelope 61. The support element 8 is designed to hold the article 12 on the support element and to position the article 12 in an aerosol-generating device. The support element 8 is arranged in the device, preferably extending from a proximal end of a device housing.

The support element 8 is basically pin-shaped having an extended middle section 80. The middle section 80 is shaped to allow smooth application of the aerosol-generating article 12 onto the support element. A cross section of the extended middle section has a varying radius and is leaf-like having four "leafs". The leafs are arranged symmetrically around the longitudinal axis of the support element 8.

The shape of the support element 8, in particular the extended middle section 80 allows an air-flow to pass in between the support element 8 and the article 12. It becomes obvious that also different numbers of leafs (for example, only three or five or more leafs) may be provided to perform the described function of the middle section.

Figure 14:
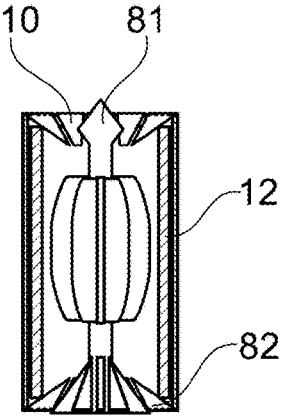

The support element 8 has a pointed tip 81 and a foot portion 81. The tip 81 facilitates a mounting and holding of the article 12 on the support element. The tip 81 also serves centering purposes of a mouthpiece as will be explained in more detail below. FIG. 14 shows the article 12 and the support element 8 in an assembled state. The folded flaps 610 of the envelope 61 of the article 12 slip below an undercut of the tip 81. The foot portion 82 has a conical shape and provides an end stop for the article 12 when being slid over the support element 8.

For non-hollow aerosol-generating articles, such as for example shown and described in FIGS. 10 and 11, the design of the support element may be adapted accordingly. For example, the support element may be provided with longitudinally extending pins extending in between the flaps or other radially extending elements of an aerosol-generating article.

Figure 15:
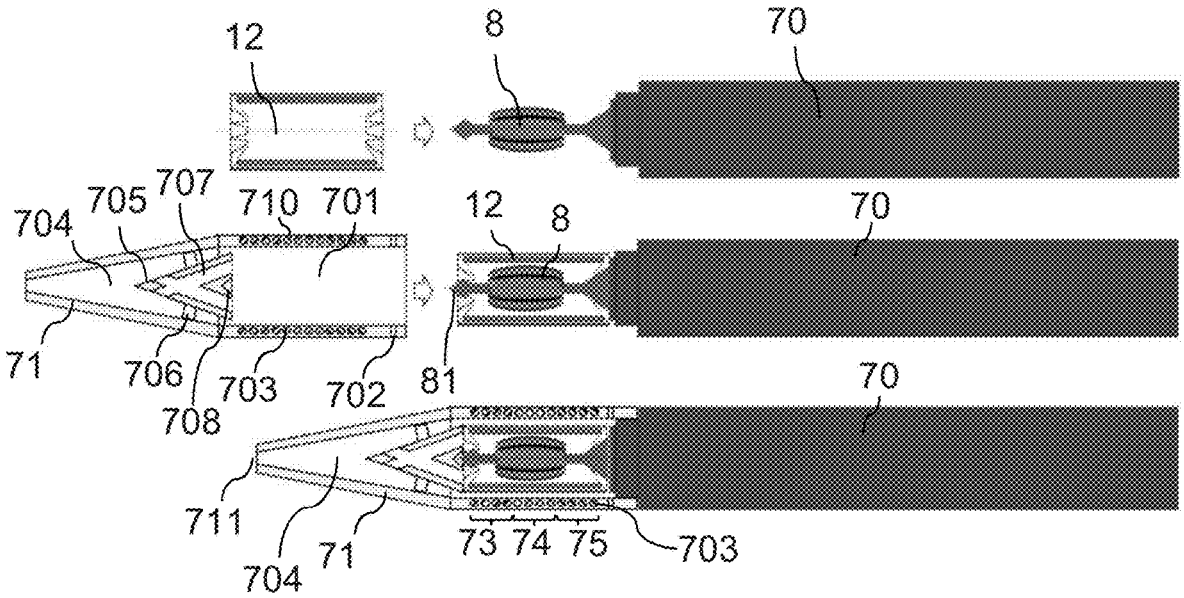
FIG. 15 are exploded and an assembled view of an embodiment of an aerosol-generating system.

FIG. 15 are exploded and an assembled view of an embodiment of an aerosol-generating system with an aerosol-generating article 12 as shown in FIG. 9 and FIG. 13. The aerosol-generating device of the system has a general tubular form and comprises a main housing 70 and a mouthpiece 71. The main housing 70 mainly comprises a battery and a power management system (not shown).

The device housing 70 comprises a support element 8 extending from the proximal end of the device housing 70. The support element 8 has been described in detail with reference to FIG. 12 and FIG. 14.

The mouthpiece 71 forms the proximal or most downstream element of the device. The mouthpiece 71 comprises a tubular hollow distal portion 710 forming and surrounding a cavity 701. The cavity 701 is provided for receiving and covering the aerosol-forming article 12 when the system is in the assembled state.

The mouthpiece 71 comprises an inductor in the form of an induction coil 703, for inductively heating susceptor material in the aerosol-generating article 12 mounted on the support element 8. The induction coil 703 is embedded in the walls of the tubular distal portion 710.

If an aerosol-generating article for segmented heating is provided, for example as shown in FIG. 5 or 6, the induction coil may be comprised of several induction coils 73,74,75 as indicated in the bottom drawing of FIG. 15. Preferably each induction coil is then provided for heating one segment of the susceptor material.

The mouthpiece 71 comprises an airflow alteration element 705 for a defined airflow management. The airflow alteration element 705 is arranged in the mouthpiece 71. In the mounted position of the mouthpiece, the airflow alteration element 705 assures self-centering and positioning of the mouthpiece 71 on the support element 8. The airflow alteration element comprises a centrally arranged indentation 708 at is distal end, which cooperates with the pointed tip 81 of the support element. Thereby, mouthpiece 71 and support element 8 and aerosol-generating article 12 accordingly, are mutually retained and positioned.

The airflow alteration element 705 is a cone influencing the airflow 91 and the mixing of the airflow 91 in the mixing chamber 704 of the mouthpiece 71. The airflow alteration element 705 is attached to the mouthpiece by fins 706.

The airflow alteration element 705 comprises passageways 707 through the airflow alteration element.

Figure 16:
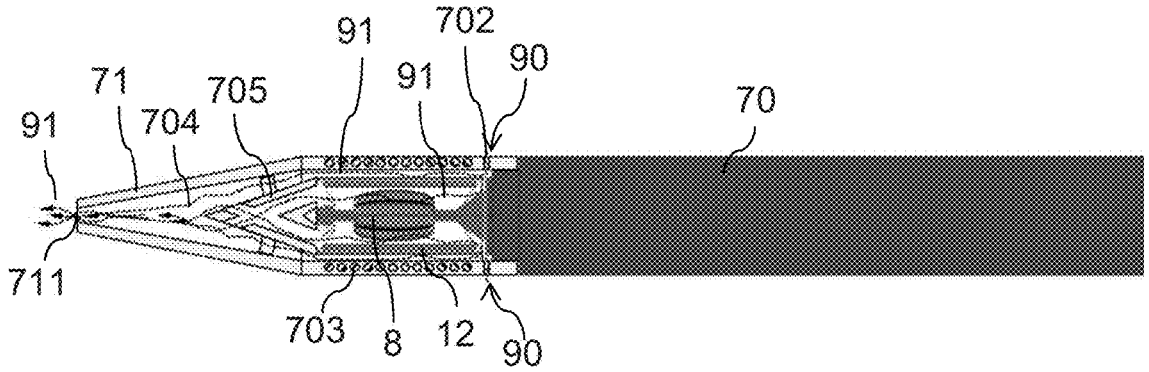
FIG. 16 illustrates the system of FIG. 15 in operation.

The mouthpiece 71 is further provided with radially arranged air-inlet channels 702 at a distal end of the mouthpiece to allow air 90 from the environment to enter the device and pass between aerosol-generating article 12 and mouthpiece wall as well as within the aerosol-generating article 12. Thereby, the air 90 picks up aerosol formed by heating the aerosol-forming substrate of the article 12. The aerosol containing air 91 continuous further downstream. An air-flow passing through the inside of the aerosol-generating article 12 passes through the passageways 707 in the airflow alteration element 705. An airflow passing along the outside of the aerosol-generating article 12 passes along the outside of the airflow alteration element 705. In the mixing chamber 704, the portion of the airflow passing through the inside of the article 12 and through the passageways 707 in the airflow alteration element 705 combines with the portion of the airflow passing the outside of the article 12 and the outside of the airflow-alteration element 705. The thoroughly mixed aerosol containing airflow 91 then leaves the mouthpiece 71 through the outlet opening 711 at the proximal end of the mouthpiece, which airflow 90, 91 is illustrated in FIG. 16.

For preparing the system for use, the mouthpiece 71 is removed from the housing 70, such as to provide open access to the support element 8.

After mounting the aerosol-forming article 12 onto the support element 8, the previously removed mouthpiece 71 may be repositioned on the housing 70, such that the device is now ready for use.

The invention claimed is:

1. An inductively heatable aerosol-generating article having a longitudinal extension, the article comprising:

aerosol-forming substrate extending along the longitudinal extension and sheet-like susceptor material extending along the longitudinal extension, the susceptor material comprising ferromagnetic material, wherein the aerosol-forming substrate and the sheet-like susceptor material are co-extruded to form an extrudate, wherein the extrudate has a same cross-sectional shape along a length of the extrudate, wherein the aerosol-forming substrate and the sheet-like susceptor material are hollow-shaped, forming a hollow extrudate;

wherein the article comprises a string element arranged between the aerosol-generating substrate and the susceptor material, wherein the string element is made of natural fibers.

2. The aerosol-generating article according to claim 1, wherein the string element is arranged along the longitudinal extension of the aerosol-generating article.

3. The aerosol-generating article according to claim 2, wherein the string element has a tensile strength such that an elongation of the string element is below 1 millimeter per meter under a load of 20 Newton.

4. The aerosol-generating article according to claim 1, wherein the susceptor material is a hollow-shaped susceptor material and the aerosol-forming substrate covers an inside of the hollow-shaped susceptor material, or an outside of the hollow-shaped susceptor material, or the inside and the outside of the hollow-shaped susceptor material.

5. The aerosol-generating article according to claim 1, wherein the susceptor material is in the form of at least two susceptor segments, and wherein the at least two susceptor segments are arranged along the longitudinal extension of the aerosol-generating article, longitudinally distanced from each other.

6. The aerosol-generating article according to claim 1, wherein a wall thickness of the extrudate is between 1 millimeter and 7 millimeter.

7. The aerosol-generating article according to claim 1, further comprising a cover material, the cover material at least partly covering the aerosol-generating article.

8. The aerosol-generating article according to claim 7, wherein the cover material is a porous material layer covering an outside of the aerosol-generating article or is a porous envelope enveloping an outside of the aerosol-generating article.

9. The aerosol-generating article according to claim 7, wherein the cover material partly covers an inside of the extrudate.

10. The aerosol-generating article according to claim 9, wherein the cover material is paper.

11. The aerosol-generating article according to claim 1, wherein the aerosol-generating article has a length between 5 and 25 millimeters.

12. The aerosol-generating article according to claim 1, wherein the string element is arranged radially outside of the susceptor material.

13. The aerosol-generating article according to claim 1, wherein the string element comprises fibers.

14. The aerosol-generating article according to claim 1, wherein the string element is a control element during manufacturing of the extrudate.

15. The aerosol-generating article according to claim 1, wherein a wall of the extrudate is a structured wall.

16. The aerosol-generating article according to claim 15, wherein the structured wall is a wavy wall.

17. The aerosol-generating article according to claim 1, wherein the susceptor material is hollow, and the aerosol-forming substrate covers at least one of an innermost surface of the susceptor material and an outermost surface of the hollow-shaped susceptor material continuously around a circumference of the susceptor material.

18. The aerosol-generating article according to claim 1, wherein the string element is a thread.

19. The aerosol-generating article according to claim 1, wherein the string element is co-extruded with the aerosol-forming substrate and the susceptor material.

* * * * *